US005842776A

United States Patent [19]

Shigemura et al.

[11] Patent Number: 5,842,776

[45] Date of Patent: Dec. 1, 1998

[54] VEHICLE LAMP DEVICE

[75] Inventors: Koji Shigemura; Miyoshi Iwamoto; Shouichi Fukusima, all of Isehara, Japan

[73] Assignee: Ichikoh Industries, Ltd., Tokyo, Japan

[21] Appl. No.: 733,645

[22] Filed: Oct. 17, 1996

[30] Foreign Application Priority Data

Oct. 17, 1995 [JP] Japan ..... 7-268410

[51] Int. Cl.[6] ..... F21V 29/00

[52] U.S. Cl. ..... 362/294; 362/61; 362/373

[58] Field of Search ..... 362/61, 294, 96, 362/373, 80, 345

[56] References Cited

U.S. PATENT DOCUMENTS

| | | | |
|---|---|---|---|
| 4,862,337 | 8/1989 | Ohshio et al. | 362/294 |
| 5,010,453 | 4/1991 | Ketterman | 362/294 |
| 5,041,949 | 8/1991 | Hirota et al. | 362/61 |
| 5,207,497 | 5/1993 | Kamishina et al. | 362/294 |
| 5,251,111 | 10/1993 | Nagengast et al. | 362/294 |
| 5,406,467 | 4/1995 | Hashemi | 362/294 |

*Primary Examiner*—Thomas M. Sember
*Attorney, Agent, or Firm*—Foley & Lardner

[57] ABSTRACT

A vehicle lamp device comprises a lighting chamber (14) defined by a housing (11) and a lens (12). A holding tube portion (11*c*) having a through hole (11*b*) is formed in a rear wall (11*a*) of the housing (11). An air pipe (15) is engaged with the holding tube portion (11*c*) through which the lighting chamber (14) is connected to the outside. An air hole (15*c*) is formed in the midway of the air pipe (15) in addition to an end opening (15*a*). A covering portion (11*d*) is formed as a holding portion in the rear wall (11*a*) for covering the air hole (15*c*) from above and for holding the air pipe (15).

8 Claims, 5 Drawing Sheets

VEHICLE LAMP DEVICE

BACKGROUND OF THE INVENTION

1. Field of the Invention

This invention relates to a vehicle lamp device in which a lighting chamber is defined by a housing and a lens closing a front opening of the housing, a holding tube portion having a through hole in a rear wall of the housing is formed, and an air pipe through which the lighting chamber is communicated to the outside is engaged with the holding tube portion.

2. Description of the Prior Art

A vehicle lamp device 6 shown in FIG. 5 is known which comprises a housing 1, a lens 2, a lighting chamber 3, an air pipe 4 and a filter 5. A front opening 1*a* of the housing 1 is closed with the lens 2 to define the lighting chamber 3. A tube portion 1*d* having a through hole 1*c* juts out of a rear wall 1*b* of the housing 1. One of the end openings of the air pipe 4 is engaged with the tube portion 1*d*.

The air pipe 4 has a sideways U-shape by molding gum or the like integrally, Further, the air pipe 4 is made hollow to lead the outside air to the lighting chamber 3 through the through hole 1*c*. The other end opening 4*a* of the air pipe 4 faces at a predetermined space toward the rear wall 1*b* of the housing 1, and thereby it becomes difficult for waterdrops to enter the end opening 4*a* from the outside although the end opening 4*a* is not closed.

The filter 5, which is made of well-known porous film cloth with a number of small holes, covers the opening end of the through hole 1*c* from the outside direction. Thereby, the outside air is allowed to enter the lighting chamber 3 so that the generation of waterdrops can be prevented which is caused by a difference in air pressure between the outside air and the air in the lighting chamber 3.

For example, in a case where the vehicle lamp device 6 is installed as a fog lamp at a relatively lower position of a body of the vehicle, there is a fear that a part of a large quantity of water will be temporarily splashed over the vehicle lamp device 6 when the vehicle runs into a pool or a puddle and thereby the water may enter in from the outside through the end opening 4*a* of the air pipe 4. As another example, there is a fear that a part of water sprayed onto the vehicle lamp device 6 by a high-hydraulic-pressure car washing machine will enter the inside from the end opening 4*a* of the air pipe 4. On these occasions, the filter 5 serves to prevent the water which has entered the end opening 4*a* from entering the lighting chamber 3.

The air in the lighting chamber 3 shrinks with the lower ambient temperature when a vehicle lamp device 6 is turned off, and this shrinkage causes the outside air to be inhaled into the air pipe 4. Accordingly, there is a possibility that a great volume of water W1 will be inhaled into the air pipe 4 if a vehicle lamp device 6 is turned off when the vehicle lamp device 6 is exposed to the water mentioned above.

The pathways of the filter 5 might be filled up with the water and be shut out when the water W1 is excessively inhaled. In this case, the outside air cannot enter the lighting chamber 3 even if air shrinkage occurs therein.

The air in the lighting chamber 3 shrinks with the passage of time, and its function of inhaling the outside air heightens. Consequently, the water W1 which has entered the air pipe 4 stays in the filter 5. If this state is kept for a while, due to the inhalation function mentioned above, a part of the water W1 enters the lighting chamber 3 from the circumferential part of the filter 5. Reference character W2 designates the water which has entered in. The inhalation function might also cause the dust or the like contained in the water W1 to adhere to the filter 5. The dust blocks the paths in the meshes of the filter 5, thereby deteriorating the inhalation function.

On the other hand, since the air pipe 4 is held on the housing 1 simply by being engaged with the tube portion 1*d*, there is a problem in that the air pipe 4 is separated from the tube portion 1*d* and cones off therefrom because the air pipe 4 swings so as to loosen gradually the engagement with the tube portion 1*d* due to the jolting of the vehicle body.

SUMMARY OF THE INVENTION

It is therefore an object of the present invention, over the aforementioned issues, to provide a vehicle lamp device in which a large quantity of water which has entered an air pipe can be drained therefrom and in which the air pipe can be prevented from falling off from a housing.

To achieve the object, in the vehicle lamp device according to the present invention in which a lighting chamber is defined by a housing and a lens closing a front opening of the housing, a holding tube portion having a through hole is formed in a rear wall of the housing, and an air pipe through which the lighting chamber is communicated to the outside is engaged with the holding tube portion, the vehicle lamp device further comprises an air hole formed in the midway of the air pipe in addition to an end opening, and a holding portion formed in the rear wall of the housing for covering the air hole from above and holding the air pipe.

DETAILED DESCRIPTION OF THE PREFERRED EMBODIMENTS

First Embodiment

A first embodiment of a vehicle lamp device according to the present invention will be hereinafter described with reference to FIGS. 1(A) through 2(C).

Figure 1A:
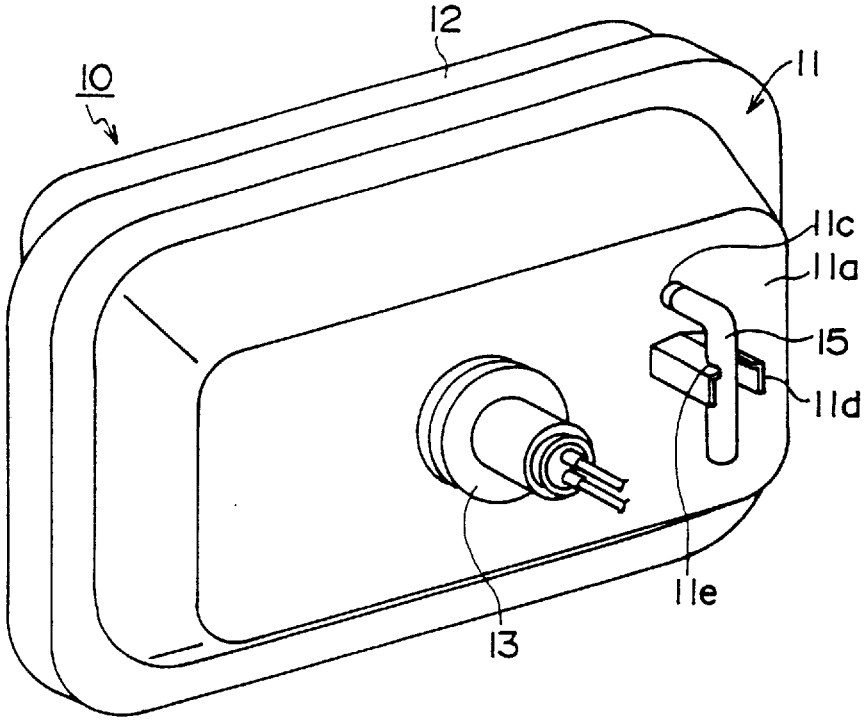
FIG. 1(A) is a perspective view showing a first embodiment of a vehicle lamp device according to the present invention.
Figure 1B:
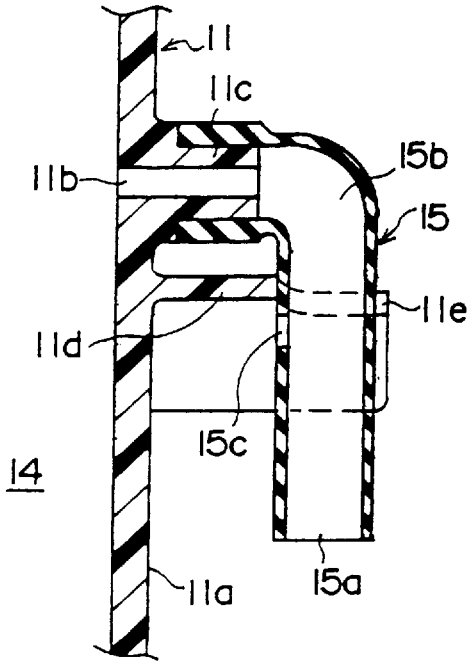
FIG. 1(B) is an enlarged sectional view of a main part of the vehicle lamp device showing the first embodiment.

In FIGS. 1(A) and 1(B), a vehicle lamp device 10 comprises a housing 11 having a front opening (not shown), a lens 12 closing the front opening of the housing 11, and a bulb 13 held on the housing 11. In the vehicle lamp device 10, a lighting chamber 14 is defined by closing the front opening of the housing 11 with the lens 12.

A tube portion 11*e* having a through hole 11*b* juts out of a rear wall 11*a* of the housing 11. A covering portion 11*d* is formed integrally with the rear wail 11*a* and juts out thereof. A concave portion 11*e* is formed at the end of the covering portion 11*d*. An air pipe 15 is engaged with the tube portion 11*c* to lead the outside air to the lighting chamber 14 through the through bolt 11*b*.

By molding gum or the like integrally, the hollow air pipe 15 is bent so as to become substantially L-shaped in section and direct an end opening 15*a* of the air pipe 15 downward. Thereby, an air path 15*b* of the air pipe 15 extends long in the upward and downward directions of a vehicle body (the upward and downward directions in FIGS. 1(A) and 1(B)). Besides, an air hole 15*c* is formed opposite to the rear wall 11*a* in the midway of the air pipe 15. The air pipe 15 is held by the covering portion 1*d* by engagement with the concave portion 11*e* of the covering portion 11*d*. The engagement position of the air pipe 15 is upper than the air hole 15*c*.

In the aforementioned construction, if the vehicle lamp device 10 is applied to a fog lamp disposed at a relatively lower position of the vehicle body, the vehicle lamp device 10 is liable to receive a splash of a large quantity of water when the vehicle moves in a pool or a puddle of the roadway. Even if the vehicle lamp device 10 is not used as a fog lamp, a part of water projected from a high-hydraulic-pressure car washing machine for washing the vehicle body might splash on the vehicle lamp device 10 for a while.

In the above occasions, water can be prevented from entering the lighting chamber 14 through the through bole 11*b* even if the water enters the air pipe 15 because the air path 15*b* extends long in the up and down directions of the vehicle body.

Additionally, since the air hole 15*c* is opposite to the rear wall 11*a,* the air hole 15*c* can be prevented from being blocked up with water to some extent ever if the water comes directly into the air hole 15*c* from the outside.

The air in the lighting chamber 14 shrinks with lower ambient temperature when the vehicle lamp device 10 is turned off. This shrinkage causes the inhaling action of the air pipe 15. Accordingly, as shown in FIG. 2(A), a great volume of water W1 might be inhaled into the air pipe 15 if the vehicle lamp device 10 is turned off at substantially the same time that the water splashes on the vehicle lamp device 10.

Nonetheless, the air hole 15*c* is kept open even when the end opening 15*a* of the air pipe 15 has been clogged with the water W1, and the outside air is inhaled through the air hole 15*c*. As a consequence, the inhaled air not only can prevent the water W1 from being inhaled still more but also can cause the water W1 to flow in the backward direction and drain therefrom.

On the other hand, there can be supposed a case where waterdrops W2 leap out of the water W1 due to a jolt of the vehicle body or the like before the water W1 which has been inhaled in the air pipe 15 is drained therefrom and, in addition to the end opening 15*a* in a closed state, the air hole 15*c* is also blocked up with the waterdrops W2.

In this case, the outside air cannot be inhaled, and the inhalation action in the lighting chamber 14 forces the water W1 to be inhaled toward the through hole 11*b*.

Nevertheless, when the water W1 is inhaled toward the through hole 11*b,* as shown in FIG. 2(B), the waterdrops W2 are united with the water W1 by the surface tension of the water W1.

Figure 2C:
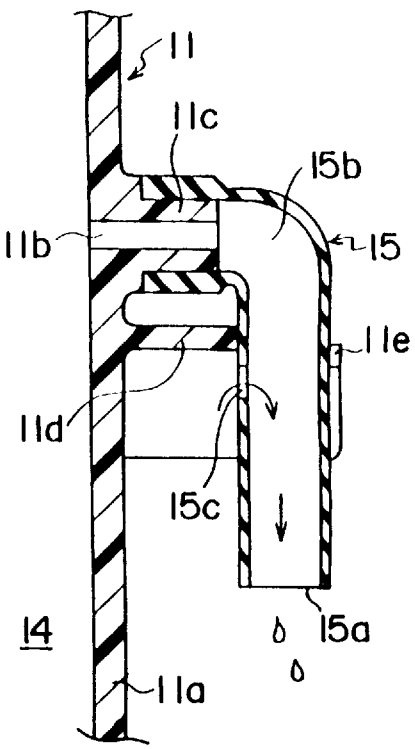
FIG. 2(C) is an enlarged sectional view of the main part of the vehicle lamp device showing a state in a process where a large quantity of water has been drained in the first embodiment.
Figure 2:
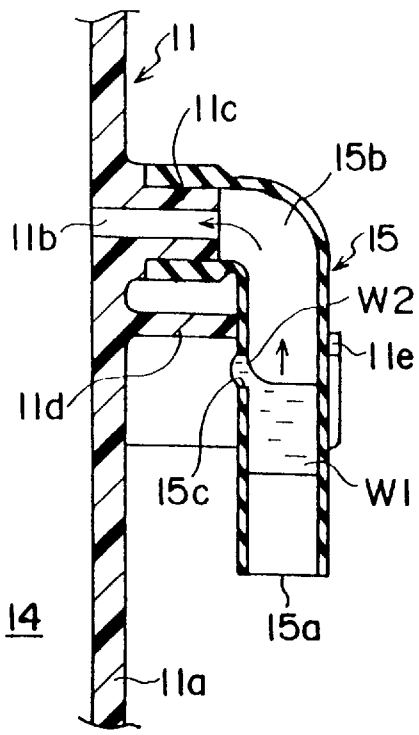
FIG. 2(A) is an enlarged sectional view of the main part of the vehicle lamp device showing an early state in a process where a large quantity of water has been inhaled in the first embodiment.
FIG. 2(B) is an enlarged sectional view of the main part of the vehicle lamp device showing a middle state in the process where a large quantity of water has been inhaled in the first embodiment.
Figure 2:
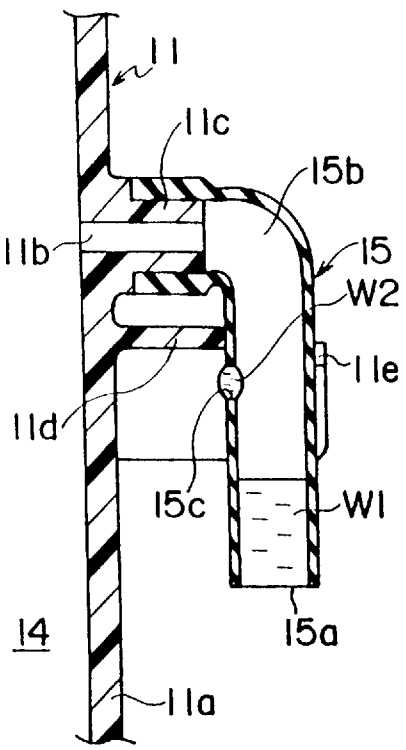

Therefore, the air hole 15*c* is opened again immediately after the water W1 and the waterdrops W2 have been united and, as shown in FIG. 2(C), the outside air is inhaled through the hole 15*c* in an open state, so that the water W1 is pushed out and drained. As a result, the water can be prevented from entering the lighting chamber 14.

Accordingly, the diameter of the opening part of the air hole 15*c* is designed to be smaller than that of the end opening 15*a* so that the water W1 and the waterdrops W2 are allowed to be united with each other by the surface tension.

There is also a case in which the waterdrops W2 is inhaled separately from the water W1 toward the inside of the air pipe 15 due to the inhalant action. When only the waterdrops W2 are inhaled, the air hole 15*c* is opened again, and the outside air inhaled according to this opening might force the waterdrops W2 and the water W1 to be drained.

Therefore, the flow of air between the lighting chamber 14 and the outside can be ensured by the air pipe 15 having the end opening 15*a* and the air hole 15*c* which are used as entries of the outside air inhaled to the inside thereof and are formed at different positions from each other. Besides, the air pipe 15 can be more easily molded than the conventional air pipe 4 having a sideways U-shape, because the air pipe 15 is formed substantially L-shaped so that the end opening 15*a* thereof is directed downward. Moreover, waterdrops can be prevented from entering the lighting chamber 14 without using the filter 5, because the air path of the air pipe 15 is formed longer. Consequently, the vehicle lamp device 10 also makes it possible to reduce the numbers of parts and operations in assembly as a result of the elimination of the filter 5.

Second Embodiment

A second embodiment of a vehicle lamp device according to the present invention will be hereinafter described with reference to FIGS. 3 to 4(B), in the second embodiment, the same numerals are given to the same parts as in the first embodiment and a detailed description of them is omitted.

Figure 3:
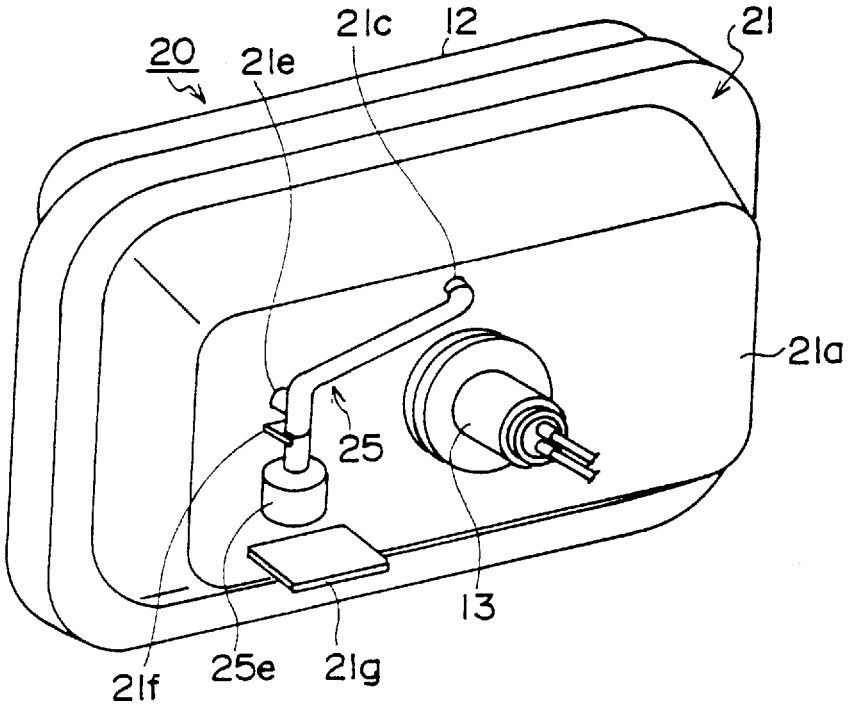
FIG. 3 is a perspective view showing a second embodiment of the vehicle lamp device according to the present invention.

In FIG. 3, a vehicle lamp device 20 comprises a housing 21 having a front opening (not shown), a lens 12, and a bulb 13. A lighting chamber 14 is defined by closing the front opening of the housing 21 with the lens 12 (see FIG. 4(A)).

Figure 4A:
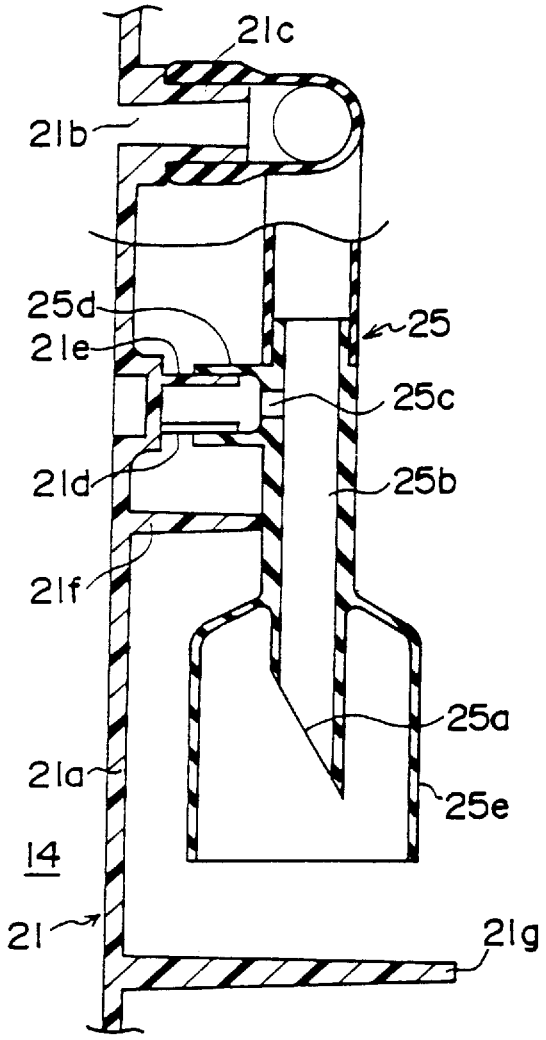
FIG. 4(A) is an enlarged longitudinal sectional view of a main part of the vehicle lamp device showing the second embodiment.
Figure 4B:
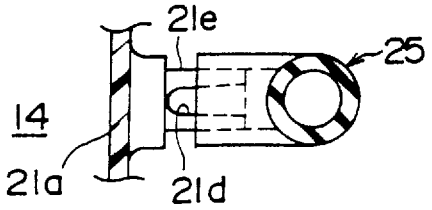
FIG. 4(B) is an enlarged horizontal sectional view of the main part of the vehicle lamp device showing the second embodiment.
Figure 5:
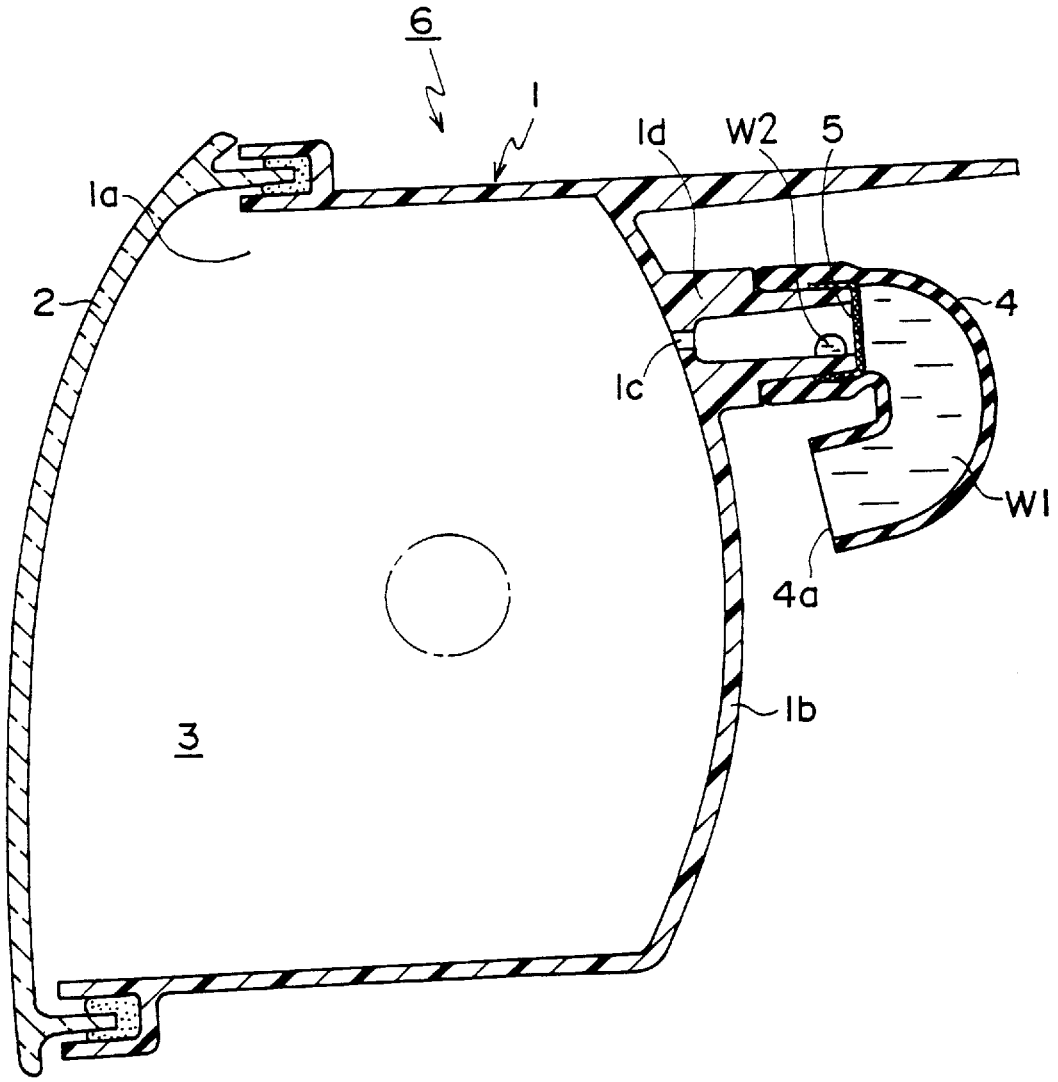
FIG.5 PRIOR ART
FIG. 5 is a longitudinal sectional view of a conventional vehicle lamp device.

As shown in FIG. 4(A), a tube portion 21*c* having a through hole 21*b* juts out of a rear wall 21*a* of the housing 21. An air pipe 25 is attached to the tube portion 21*c,* and thereby the outside air is led to the lighting chamber 14 through the through hole 21*b*. In the rear wall 21*a,* there are additionally formed a cylindrical projecting portion 21*e* having a guide path 21*d* which is opened in the downward direction of a vehicle body, an assistant holding tongue portion 21*f* which is engaged with the air pipe 25, and a horizontal wall 21*g* which is opposite with a predetermined space to an end opening 25*a* of the air pipe 25.

The air pipe 25, which is a hollow mold made of gum or the like, is offset sideward and then is bent so as to direct the end opening 25*a* of the air pipe 25 in the downward direction. In lieu of the aforementioned formation, as shown in FIGS. 4(A) and 4(B), the air pipe 25 may be composed of two separate pipes. An air path 25*b* of the air pipe 25 extends long in the upward and downward directions of the vehicle body. An air hole 25*c* opposite to the rear wall 21*a* and a tube portion 25*d* surrounding the air hole 25*c* are formed in the midway of the air pipe 25. The air pipe 25 is held on the housing 21 by engaging the tube portion 25*d* with the cylindrical projecting portion 21*e*.

The through hole 21*b* is allowed to communicate with the outside air not only through the end opening 25*a* but also through the guide path 21*d*, because the through hole 21*b* is connected to the guide path 21*d* via the air hole 25*c*, the tube portion 25*d*, and the cylindrical projecting portion 21*e*, in a state in which a part of the guide path 21*d* in the upward direction of the vehicle body (in the upward direction in FIG. 4(A)) is covered with the tube portion 25*d*.

In this construction, there can be obtained almost the same effects as on retaining the flow of air between the lighting chamber 14 and the outside, and on coping with the situation in which water has been inhaled into the air pipe 15 in the construction of the air pipe 15 of the second embodiment. The assistant holding tongue portion 21*f* in this embodiment serves to secondarily prevent the swing of the air pipe 25 caused by the additional disposition of an umbrella type member 25*e* with which the end opening 25*a* is covered around the lower end of the air pipe 25. An air pipe, such as the air pipe 15 in the first embodiment, without the umbrella type member 25*e* does not necessarily require the assistant holding tongue portion 21*f*. the horizontal wall 21*g* serves to prevent the water splashed from the lower part of the vehicle body from entering the end opening 25*a* (prior art). The horizontal wall 21*g* may be formed in the housing 11 which holds the air pipe 15.

As described above, in the vehicle lamp devices of the first and second embodiments of the present invention, the air hole 15*c*, in addition to the end opening 15*a*, is formed in the midway of the air pipe 15, and the covering portion 11*d* is formed as a holding portion for holding the air pipe 15 in the rear wall 11*a* so as to cover the air hole 15*c*. Therefore, L large quantity of water W1 which has entered the air pipe 15 can be drained and, in addition, the air pipe 15 can be prevented from falling off.

The end of the air pipe 15 which is directed downward allows a large quantity of water W1 which has entered the air pipe 15 to drop by its own weight, and the long air path 15*b* prevents the water W1 from entering the lighting chamber 14.

The diameter of the opening part of the air hole 15*c* is designed to be smaller than that of the end opening 15*a*, and thereby the water W1 and the waterdrops W2 are allowed to be united with each other by the surface tension and, as a result, the outside air enters into through the air hole 15*c*, even if both the end opening 15*a* and the air hole 15*c* are blocked up with the water W1 and the waterdrops W2.

Further, since the air hole 15*c* is opposite to the rear wall 11*a*, the air hole 15*c* can be prevented from being blocked up with water even if the water comes directly into the air hole 15*c* from the outside.

The covering portion 11*d* is formed as a holding portion at the upper part of the air pipe 15, and thus waterdrops dropping from and along the upper part of the air pipe 15 cannot enter the air hole 15*c*.

The tube portion 25*d* encircling the air hole 25*c* is formed integrally with the air pipe 25, and the cylindrical projecting portion 21*e* is engaged with the tube portion 25*d* and has a guide path 21*d* which is opened in the downward direction of the vehicle body so as to lead the outside air to the air hole 25*c* via the tube portion 25*d*. Consequently, the effect of preventing waterdrops from entering the air hole 25*c* can be heightened still more.

Since the umbrella type member 25*e* is formed lower than the end opening 25*a* of the air pipe 25 so as to surround the end opening 25*a*, the effect of preventing water from entering into through the end opening 25*a* can be heightened still more.

Besides, since the end opening 25*a* of the air pipe 25 is cut obliquely, the effect of preventing water from entering into through the end opening 25*a* can be heightened still more.

What is claimed is:

1. A vehicle lamp device, comprising:

a lighting chamber defined by a housing and a lens with which a front opening of said housing is closed;

a holding tube portion having a through hole in a rear wall of said housing; and an air pipe through which air is admitted into said lighting chamber, said air pipe being attached to said holding tube portion;

wherein said air pipe has an air hole formed in a midway of said air pipe, in addition to an end opening formed in an end thereof; and an air pipe holding portion for holding said air pipe is formed in the rear wall of said housing so as to cover said air hole from above.

2. A vehicle lamp device according to claim 1, wherein the end of said air pipe is directed downward.

3. A vehicle lamp device according to claim 1, wherein a diameter of said air hole is smaller than that of said end opening.

4. A vehicle lamp device according to claim 1, wherein said air hole faces said rear wall.

5. A vehicle lamp device according to claim 1, wherein said air pipe holding portion serves as a cover to prevent drops of water dripping from an upper part of said air pipe along said air pipe from entering said air hole.

6. A vehicle lamp device according to claim 1, further comprising a tube encircling said air hole and formed integrally with said air pipe, said air pipe holding portion being engaged with said tube and being formed into a tubular projection which has a guide path formed so as to be opened in a downward direction of a vehicle body and admit air into said air hole through said tube.

7. A vehicle lamp device according to claim 6, further comprising an umbrella type member formed on said air pipe so as to enclose said end opening, said umbrella type member being positioned lower than said end opening.

8. A vehicle lamp device according to claim 6, wherein said end opening is cut obliquely.

* * * * *